US007552980B2

(12) United States Patent
Schulman

(10) Patent No.: US 7,552,980 B2
(45) Date of Patent: Jun. 30, 2009

(54) ELECTRONIC COMPONENT FURNITURE CONSTRUCTION AND METHODS AND APPARATUS THEREFOR

(76) Inventor: Carl H. Schulman, 3362 Caminito Luna Nueva, Del Mar, CA (US) 92014

( * ) Notice: Subject to any disclaimer, the term of this patent is extended or adjusted under 35 U.S.C. 154(b) by 388 days.

(21) Appl. No.: 10/815,358

(22) Filed: Apr. 1, 2004

(65) Prior Publication Data

US 2005/0012437 A1 Jan. 20, 2005

Related U.S. Application Data

(60) Provisional application No. 60/487,864, filed on Jul. 15, 2003.

(51) Int. Cl.
*A47B 88/00* (2006.01)

(52) U.S. Cl. ..... 312/323; 312/223.3; 312/246

(58) Field of Classification Search ..... 312/223.3, 312/194, 310, 311, 208.1, 322, 323, 312, 312/270.1, 270.2, 270.3, 291, 246, 330.1
See application file for complete search history.

(56) References Cited

U.S. PATENT DOCUMENTS

| | | | | | |
|---|---|---|---|---|---|
| 427,217 | A | * | 5/1890 | Bancroft | 312/21 |
| D26,812 | S | | 3/1897 | Gramelspacher | |
| 820,272 | A | * | 5/1906 | Vaaler | 312/25 |
| 886,017 | A | | 4/1908 | Schram et al. | |
| 886,192 | A | | 4/1908 | DeCanio | |
| 993,588 | A | * | 5/1911 | Donning | 312/208.1 |
| 1,990,980 | A | | 2/1935 | Fakkema | |
| 2,155,293 | A | * | 4/1939 | Bargen | 312/29 |
| D118,637 | S | | 1/1940 | Dyches | |
| D133,524 | S | | 8/1942 | Bargen | |
| 2,785,036 | A | | 3/1957 | Elsden-King et al. | |
| 3,292,986 | A | | 12/1966 | Fenwick | |
| 3,589,524 | A | | 6/1971 | Schramm | |
| 3,722,975 | A | | 3/1973 | Taylor | |
| 3,954,315 | A | | 5/1976 | Sanden | |
| 4,145,097 | A | * | 3/1979 | Naess et al. | 312/223.3 |
| D276,772 | S | | 12/1984 | Snediker | |
| 4,615,095 | A | | 10/1986 | Bessinger et al. | |
| 4,669,789 | A | | 6/1987 | Pemberton | |
| 4,695,104 | A | | 9/1987 | Lederman | |
| 4,836,623 | A | | 6/1989 | Holland | |
| 4,892,367 | A | | 1/1990 | Jantzen | |
| 5,119,942 | A | | 6/1992 | McCullars | |
| 5,199,773 | A | * | 4/1993 | Price et al. | 312/194 |
| 5,231,552 | A | | 7/1993 | Schneider et al. | |
| 5,456,468 | A | * | 10/1995 | Stringfellow et al. | 312/223.3 |
| 5,589,849 | A | * | 12/1996 | Ditzik | 248/921 |

(Continued)

FOREIGN PATENT DOCUMENTS

| | | | | |
|---|---|---|---|---|
| DE | 3308872 | * | 9/1984 | 312/223.3 |

(Continued)

*Primary Examiner*—Hanh V Tran
(74) *Attorney, Agent, or Firm*—The Belles Group, P.C.

(57) ABSTRACT

There is provided a furniture construction having a moveable support structured to support at least one electronic component in a first position that is generally horizontal and in a second position that is at a downwardly inclined angle at least partially within the interior of a housing so that the front and rear of the electronic component can be easily accessed.

4 Claims, 11 Drawing Sheets

U.S. PATENT DOCUMENTS

D385,431 S 10/1997 Lee
5,678,905 A 10/1997 Kelley
5,741,053 A 4/1998 Nielsen
5,797,666 A * 8/1998 Park ..... 312/223.3
5,944,396 A 8/1999 Stephan
5,957,059 A * 9/1999 Burhman ..... 312/194
6,022,087 A 2/2000 Gilbert
6,076,906 A 6/2000 Royal
6,082,844 A 7/2000 Hausler et al.
6,102,476 A 8/2000 May et al.
6,164,462 A 12/2000 Mumford
6,170,926 B1 1/2001 Roberts et al.
6,206,495 B1 3/2001 Peterson
D441,567 S 5/2001 Nielsen
D445,597 S 7/2001 Stone et al.
D446,188 S 8/2001 Gershfeld
D449,819 S 10/2001 Gershfeld
6,340,212 B1 1/2002 Beiss et al.
D454,541 S 3/2002 Gershfeld
D455,123 S 4/2002 Gershfeld
D455,716 S 4/2002 Gershfeld
D456,357 S 4/2002 Gershfeld
D457,137 S 5/2002 Gershfeld
6,402,271 B1 6/2002 Kelley et al.
6,446,564 B1 9/2002 Anderson
6,480,352 B1 11/2002 Okada et al.
D466,868 S 12/2002 Gershfeld
6,508,526 B2 1/2003 Reppas et al.
D472,405 S 4/2003 Tzeng
6,553,919 B1 4/2003 Nevin
6,580,602 B2 6/2003 Zodnik
D478,225 S 8/2003 Wang
6,612,665 B2 9/2003 Nielsen
6,619,765 B2 9/2003 Visser et al.
6,736,469 B2 5/2004 Long
6,802,577 B2 * 10/2004 Gershfeld ..... 312/223.3

FOREIGN PATENT DOCUMENTS

WO 8606575 * 11/1986 ..... 312/223.3

* cited by examiner 10
12a
45
21
41
44
20
12
24
38
26
21
29
34
23
11
14
28
25
31
18
19
16
27

10
29
45
41
44
20
12a
12
24
38
26
34
23
14
11
31
28
25
18
19
27
16

10
45
12
41
44
20
12a
24
29
26
34
23
14
31
28
38
25
11
18
19
27
16

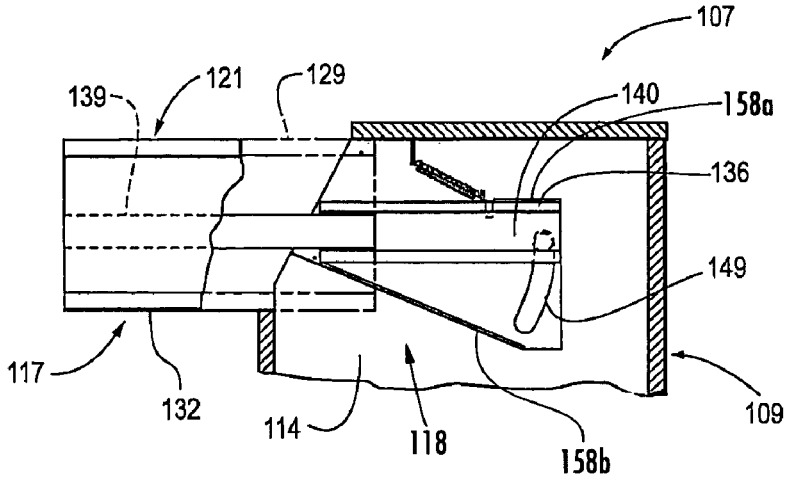
FIG. 17
FIG. 18
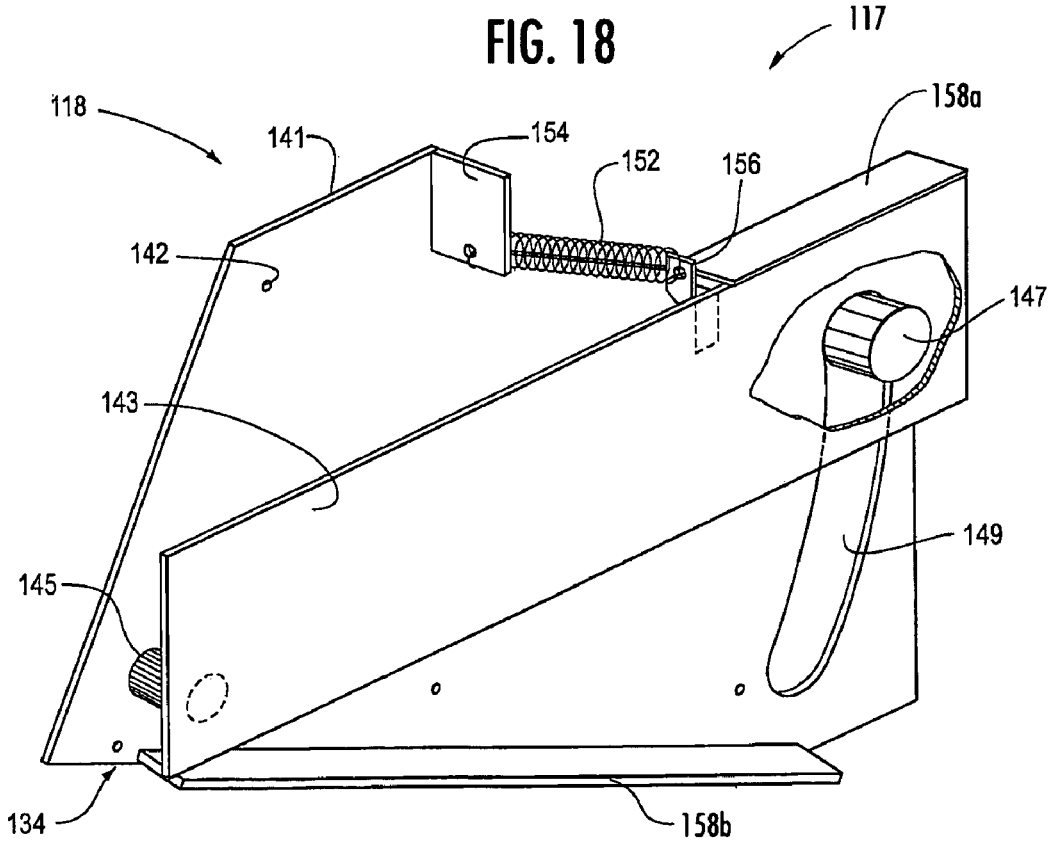

ELECTRONIC COMPONENT FURNITURE CONSTRUCTION AND METHODS AND APPARATUS THEREFOR

RELATED APPLICATIONS

This application claims priority to U.S. provisional patent application Ser. No. 60/487,864, filed Jul. 15, 2003, and entitled "ELECTRONIC COMPONENT PULL-OUT SHELF CONSTRUCTION AND METHOD," and incorporates it by reference as if fully set forth herein in its entirety.

BACKGROUND OF THE INVENTION

1. Field of the Invention

The present invention relates generally to a furniture construction, method and apparatus for use with electronic components and, more particularly, relates to such a furniture construction and method as well as apparatus suitable for use as home entertainment centers, computer desks and other applications in connection with a variety of electronic components.

2. Description of Related Art

There have been a variety of different types and kinds of furniture used for housing electronic equipment, including television sets, stereo equipment, computers, VCRs, DVDs and many others. For example, home entertainment centers have employed furniture used to house electronic equipment such as television sets, stereo equipment, as well as many components associated therewith. As used herein, "electronic components" include, but is not limited to, television sets, stereo equipment, receivers, tuners, tape decks, recording units, computer processor units, printers, scanners, VCRs, DVD players, DVD recorders, cable and satellite tuners and other audio visual and multi-media equipment. In this manner, several electronic components can be conveniently stored in one or more pieces of furniture. However, in most instances, the line of sight to the components is at a low level and it is necessary to bend or lean over in order to view or access the front positioned controls. Additionally, while the use of such furniture components enables the wiring or cabling of the various electronic components to be concealed from view, such wiring or cabling is typically not easily accessible.

One example of such furniture includes a computer desk as used in the home or office. In this regard, the computer desks conveniently store electronic components such as personal computers as well as related components such as printers and scanners. The desks are oftentimes designed to conceal the cabling for the various components.

In both the home entertainment center and computer desk examples, it has been somewhat difficult in certain circumstances to troubleshoot or otherwise change settings for re-cabling components due to the cabling not being easily accessible. Since the electronic components are normally installed within the furniture piece itself, it is oftentimes difficult to remove, install, replace or change the electronic component in question, to re-cable the electronic component or otherwise adjust the cabling of the electronic component.

In the case of the computer desk, a computer processor unit (CPU) or tower computer may be placed outside of the computer desk and may rest on the floor near the desk. In general, modern computers require access to both the front and rear for a variety of purposes. With the computer processor unit placed outside of the computer desk and resting on the floor or at another location, it may be inconvenient at best to access both the front and rear of the computer processor unit for loading or unloading compact disks or performing other required operations or connections. Moreover, if these tasks are repetitive, such an arrangement may not be ergonomically appropriate for the user. Additionally, while all of the other components, such as the monitor and keyboard for the computer, are mounted in the desk in a convenient manner, the largest component, the CPU, may not even be accommodated within the confines of the computer desk.

BRIEF DESCRIPTION OF THE SEVERAL VIEWS OF THE DRAWINGS

Reference will now be made to the accompanying drawings, which are not necessarily drawn to scale, and wherein:

FIG. 17 is a side-elevational fragmentary sectional side-elevational view of the furniture construction of FIG. 14 shown with its movable support being disposed in its horizontal position;

FIG. 18 is an enlarged scale pictorial view of the support apparatus illustrated in the construction of FIG. 14;

DETAILED DESCRIPTION OF THE INVENTION

Figure 1:
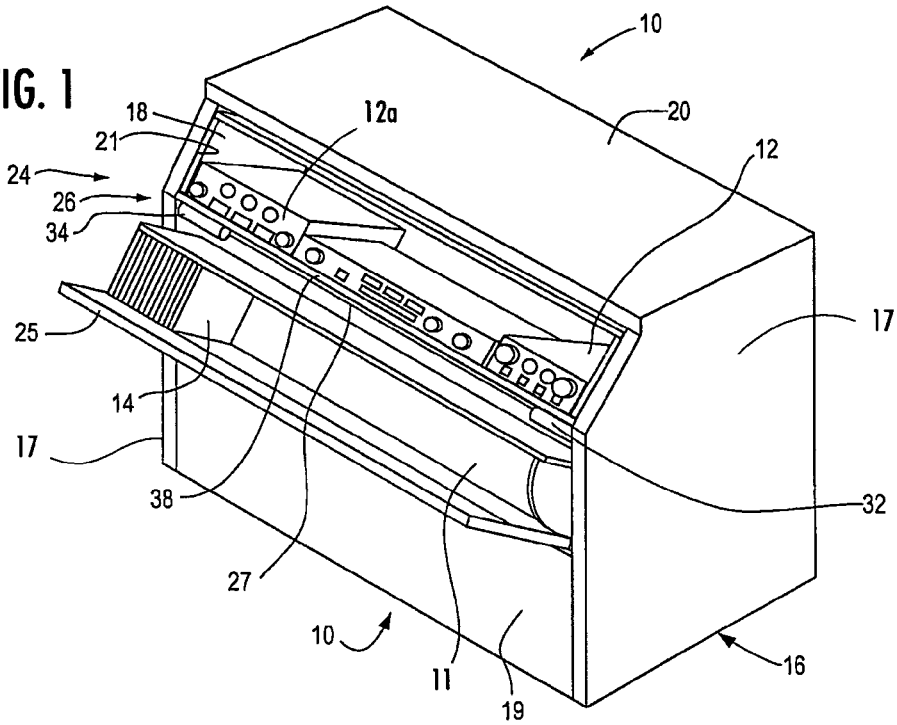
FIG. 1 is a pictorial view of an entertainment center furniture construction in accordance with one embodiment of the present invention.

The present invention will now be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

According to the present invention, there is provided a furniture construction and method as well as apparatus therefor, wherein electronic components are supported on a support assembly having a support that is movable between a first position that is generally horizontal and a second position that is at a downwardly inclined angle. In this manner, the electronic components may be readily accessed and used since the front of the components are disposed at an ergonomically appropriate upward angle toward the user in a convenient manner and at a convenient height. Thus, the front of the components may be conveniently seen at a distance, and may be readily accessed by a user without the need to bend or lean over.

The support assembly includes supporting apparatus structured to support the moveable support at least partially within the interior of the housing of the furniture construction so that the support is moveable between the first and second positions. In the first position, which is generally horizontal, the user has convenient and easy access to the rear of the electronic components. In this regard, the electronic components can be re-cabled or otherwise accessed to repair or replace them in a convenient manner. Also, according to the disclosed embodiments, because the support is moveable to the second position, which is at a downwardly inclined angle, the overall depth of the furniture construction may be reduced for some applications as compared to conventional furniture units with supports structured only to horizontally support the electronic components, thereby improving the design of the furniture construction particularly in view of the trend to reduce the overall dimensions of many electronic components.

Additionally, according to some embodiments, in the angular space below the moveable support when it is disposed at the downwardly inclined angle of the second position, the furniture construction can include one or more media storage compartment or shelf that is rotatably supported within the interior of the furniture construction. According to these embodiments, the door for this compartment can be swung outwardly from a horizontal to an angular position to display the storage media in a convenient and ergonomically appropriate manner to the user. For certain applications, the title of the media is in the direct line of sight and the media is in arms length reach of the user without the requirement to bend or lean over.

Referring now to the drawings, and more particularly to FIGS. 1-7, there is shown a furniture construction 10, which is constructed in accordance with an embodiment of the invention, and which is in the form of a home entertainment center for storing electronic components such as an electronic component 12, as well as for storing audio and/or audio-visual media storage packages such as a media storage package 14. The media storage package 14 can include, but is not limited to, DVDs, CDs, tapes, records, VCR tapes, computer diskettes and other audio and/or audio-visual media storage packages. The furniture construction 10 includes a housing 16 having a front side 19, a top 20 and two lateral sides 17 defining an interior 18 therebetween structured to at least partially receive and store an electronic component 12. The housing 16 defines an opening 21 for viewing the front 12*a* of the electronic component such as the component 12.

Figure 25:
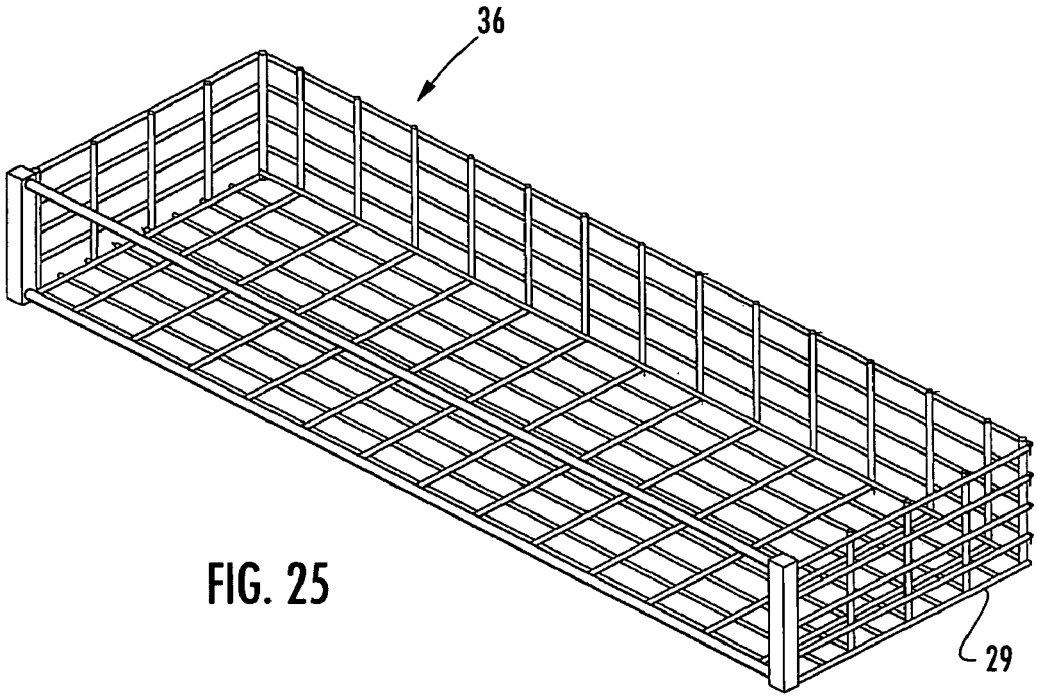
FIG. 25 is an enlarged scale pictorial view of a movable support, according to another embodiment of the present invention.

The furniture construction 10 includes a support assembly 24 structured to support the electronic component 12 at least partially within the interior 18 of the housing 16. The support assembly 24 includes a moveable support 29 structured to support the electronic component 12 in the first and second positions and supporting apparatus generally indicated at 26 that is structured to be attached, at least in part, to the housing 16 and structured to at least partially support the moveable support 29 in the first and second positions. According to the embodiment illustrated in FIGS. 2-7, the moveable support 29 includes a drawer or shelf 23, as illustrated in FIGS. 1-7, or a wire basket 36, as illustrated in FIG. 25. As illustrated in FIGS. 3-6, the supporting apparatus 26 includes a base 31 with an upstanding rear wall or flange 28. The supporting apparatus 26 further includes a pair of short rollers 32 and 34 disposed below the moveable support 29 near the opening 21 to help facilitate rollably supporting the moveable support 29 from below. It should be understood that a single long roller may also be employed and/or that one or more pairs of short rollers may be employed.

Figure 7:
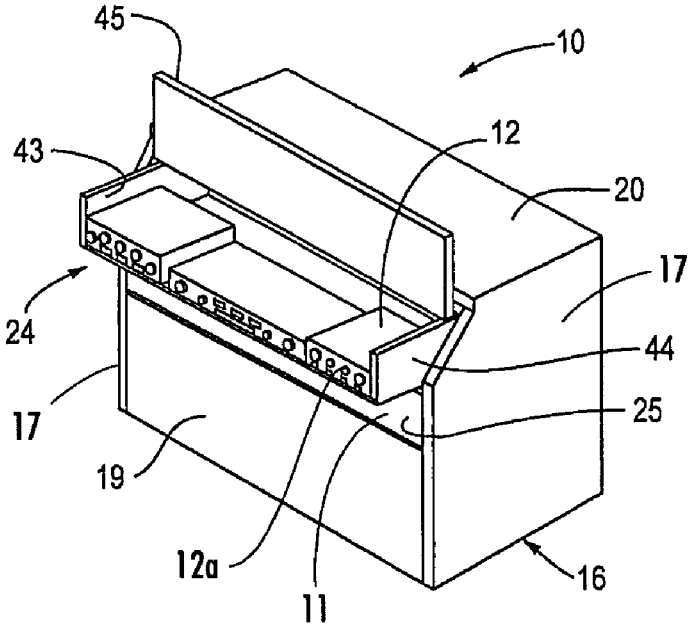
FIG. 7 is a pictorial view of the furniture construction of FIG. 1, illustrating the movable support in its opened position.

In use, the moveable support 29 (i.e., the drawer or shelf 23 or basket 36) supporting the electronic component 12 may be pulled out of the use position (i.e., the second position in which the electronic component is disposed at a downwardly inclined angle) as indicated in FIG. 1, and into a generally horizontal position as shown in FIG. 7 so that the user can gain access to each one of the electronic components 12 for re-cabling or other access purposes. The moveable support 29 can be pulled manually by the user or by a suitable motive mechanism (not shown) such as a motor or piston cylinder assembly, from the angular second position within the housing 16 through the opening 21. As the moveable support 29 is pulled through the opening 21 the moveable support can be pivoted about the rollers 32 and 34 into the first position wherein the moveable support is in a generally horizontal position as shown in FIG. 7.

Figure 4:
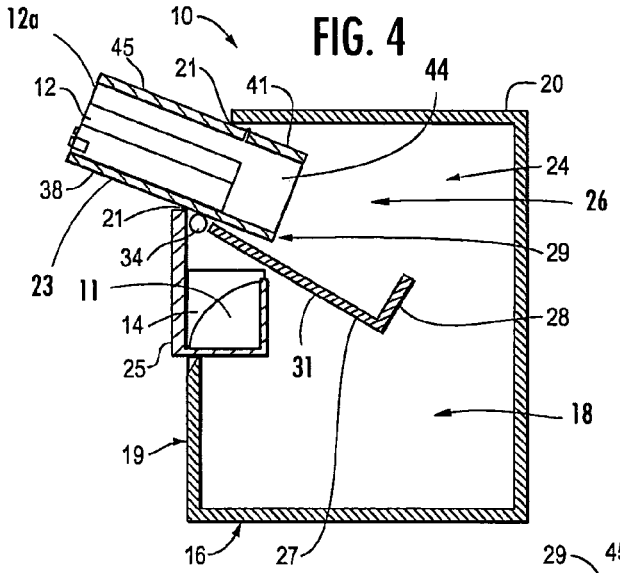
FIGS. 4 through 6 are diagrammatic sectional side elevational and pictorial views of the entertainment center furniture construction of FIG. 1 illustrating it in the process of its moveable electronic component support being moved from its angularly inclined storage position to its outward horizontal position.
Figure 5:
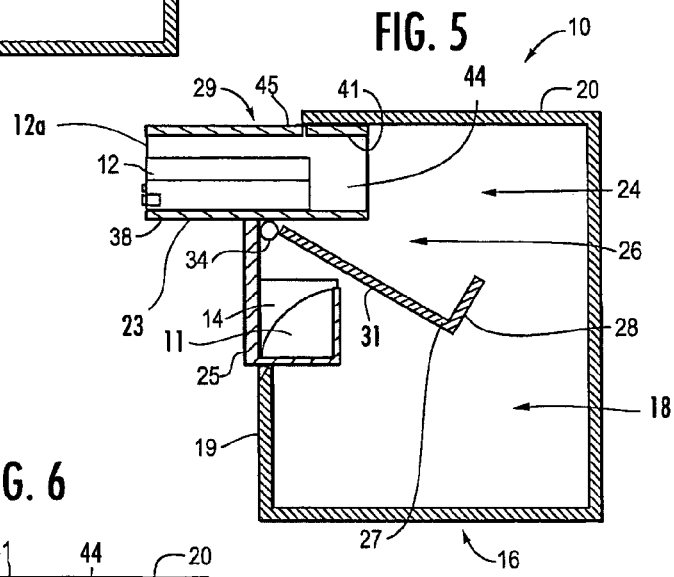
Figure 6:
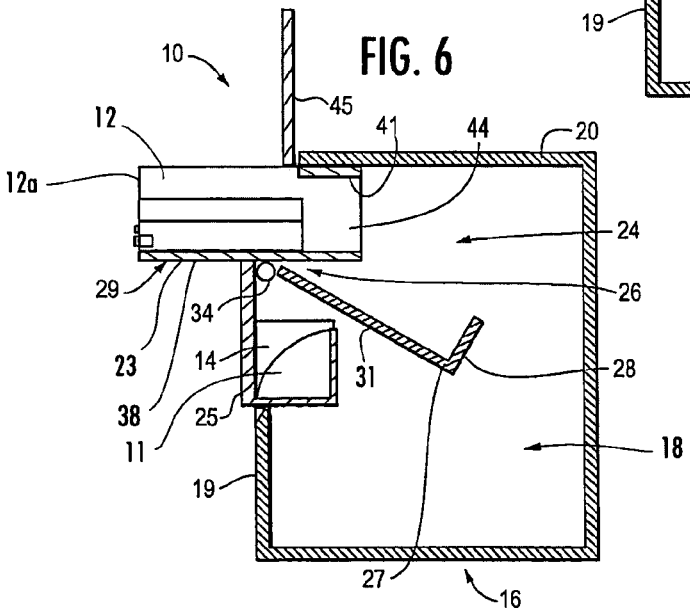

As shown in the progressive views illustrated in FIGS. 2 through 6, the moveable support 29 is pulled through the opening 21 resulting in the support sliding forwardly and upwardly along the inclined base 31 of the supporting apparatus 27 and rolling on the rollers 32 and 34. As shown in FIG. 4, once the moveable support 29 moves sufficiently outwardly from the housing 16 through the opening 21 to a position where the weight of the moveable support 29 and its contents causes the center of gravity thereof to be disposed outside of the housing 16, the moveable support 29 starts to pivot about the rollers 32 and 34 and move into a generally horizontal disposition as shown in FIG. 5. According to one embodiment, as shown in FIGS. 5 and 6, the upward rear-end portion of the moveable support 29 engages the underside of the top 20 of the housing 16 at the opening 21 to limit the pivoting motion of the moveable support. In so doing, the moveable support 29 is supported in a cantilevered arrangement at the opening 21 by the underside of the top 20 of the housing 16.

Considering now the moveable support 29 illustrated in FIGS. 1-7 in greater detail, the support comprises a drawer 23 includes a bottom 38 for supporting the electronic components 12 from below, and a top 41 which engages the underside of the top 20 of the housing 16 as shown in FIGS. 5 and 6. A pair of sidewalls 43 and 44 complete the structure of the drawer 23, which has an open front portion so that the front of the electronic components 12 can be readily viewed and accessed through the opening 21. The top 41 may included a hinged top door 45. The top door 45 is typically disposed in a closed position parallel to the bottom 38 when the drawer 23 is disposed in its angular second position during use. When the drawer 23 is pulled outwardly into the generally horizontal first position or access position as shown in FIGS. 6 and 7, the door 45 may be swung upwardly into a generally vertical position to permit greater access to the electronic component or components 12. The drawer 23 may include a handle (not shown) to assist the user in pulling the drawer out manually.

Figure 2:
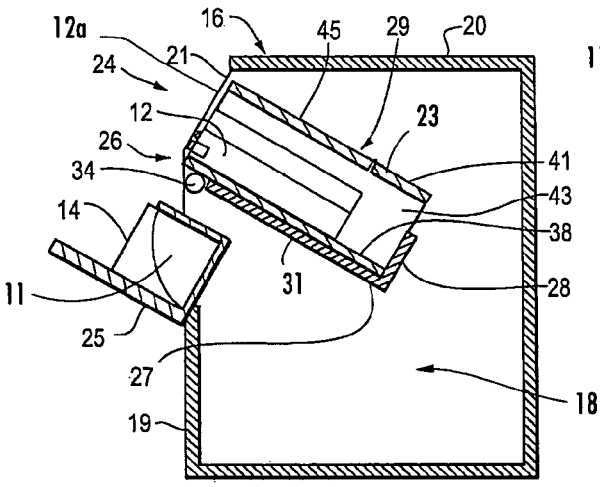
FIGS. 2 and 3 are diagrammatic sectional side elevational views of the entertainment center furniture construction of FIG. 1, illustrating a media flip storage compartment being moved between its opened position and its closed position.
Figure 3:
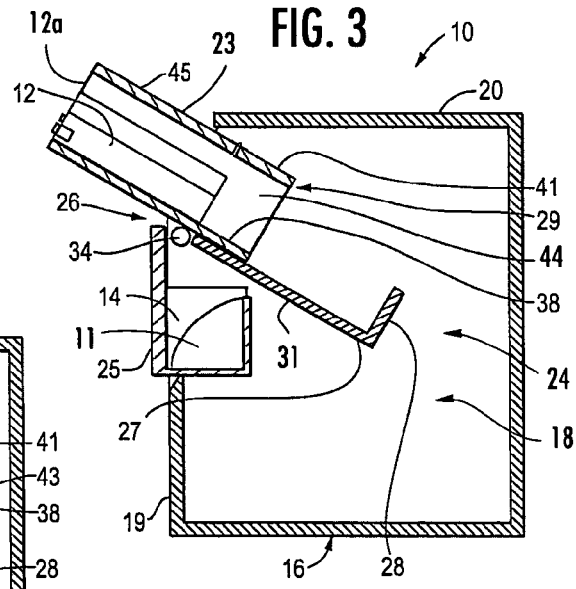

It should be understood that the electronic components 12 are disposed with their front positioned adjacent to the front opening in the moveable support 29 (i.e., drawer 23 or basket 36) so that they can be readily viewed and accessed through the opening 21 in the housing 16 when the moveable support 29 is disposed in its angular second position as illustrated in FIGS. 1 and 2. In order to retain the electronic components 12 in their position within the moveable support 29, the weight of the components may provide sufficient frictional engagement with the bottom 38, or the components can be secured to the bottom 38 by adhesives or other suitable techniques or structures, such as a ribbed surface, etc. or the openings in the basket 36. In addition to retaining the electronic components 12 on the moveable support 29, the basket 36 also provides other advantages, including providing heat ventilation away from the electric components.

As shown in FIG. 1, the housing 16 can include a media storage compartment shelf 11 that is rotatably supported within the interior 18 of the housing in the space below the support assembly 24 such that the shelf can be pulled out or flipped down. The shelf 11 has a door 25 that can be rotated or swung forwardly and downwardly into the open angular position shown in FIG. 1. In this position, the media packages 14 are displayed at an angular position so that they can be conveniently observed and/or retrieved by the user.

Figure 8:
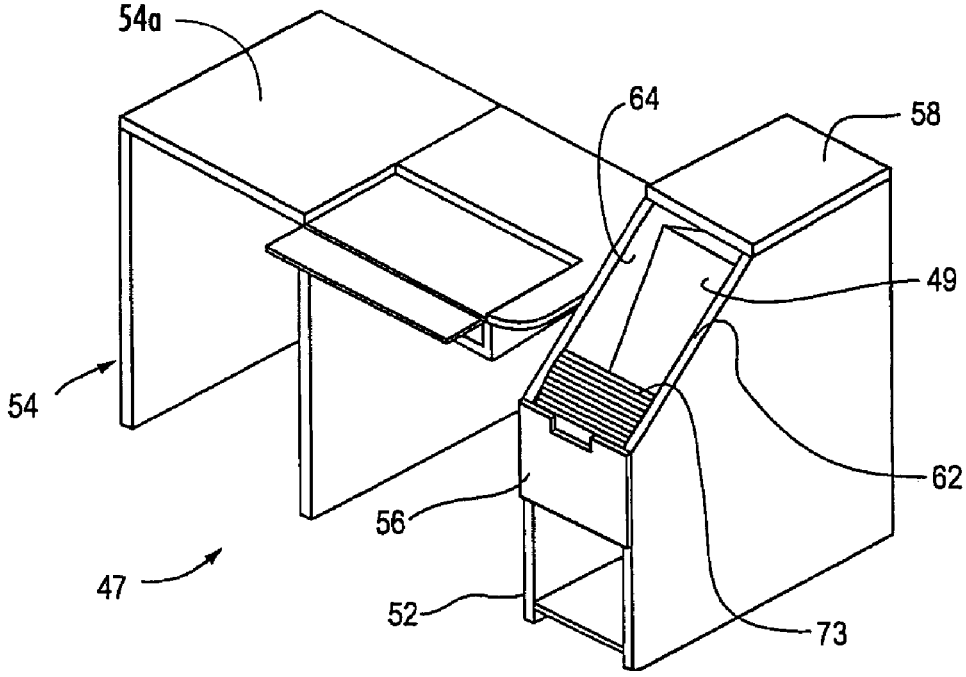
FIG. 8 is a pictorial view of a desk furniture construction, which is constructed in accordance with another embodiment of the present invention.
Figure 9:
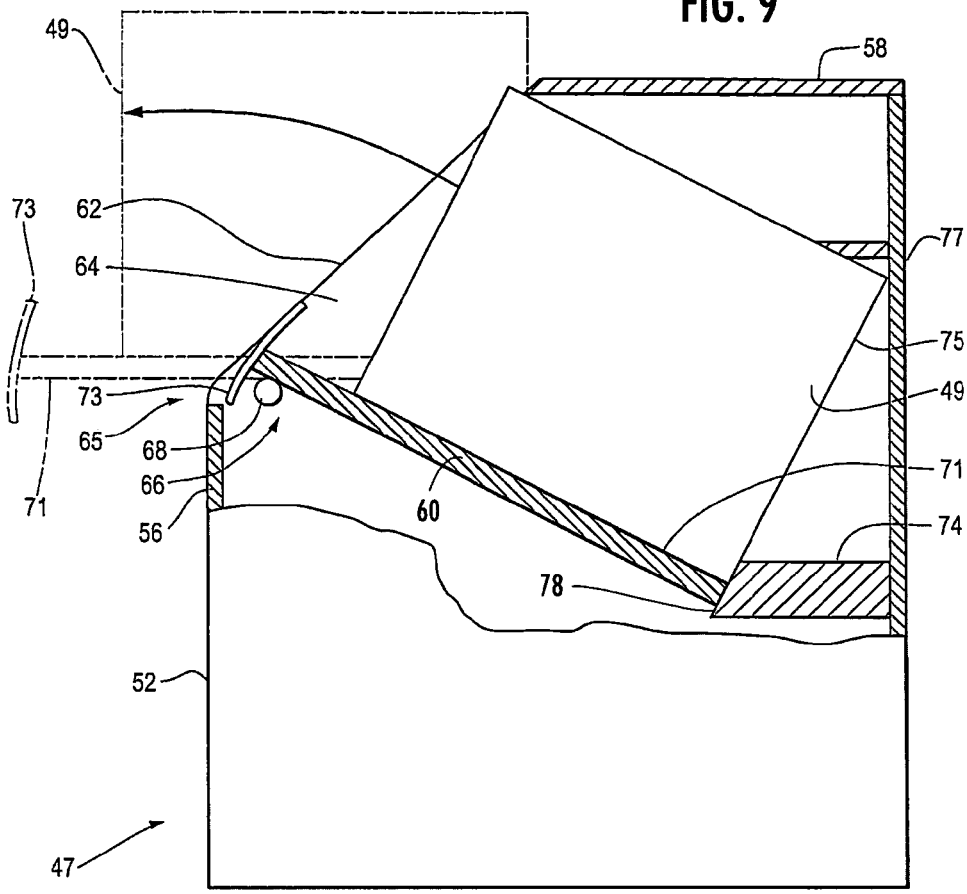
FIG. 9 is a fragmentary sectional side elevational view of the construction of FIG. 8, illustrating its moveable support shelf transitioning from its stored position to its horizontal, substantially unobstructed rear accessible position shown in broken lines.
Figure 10:
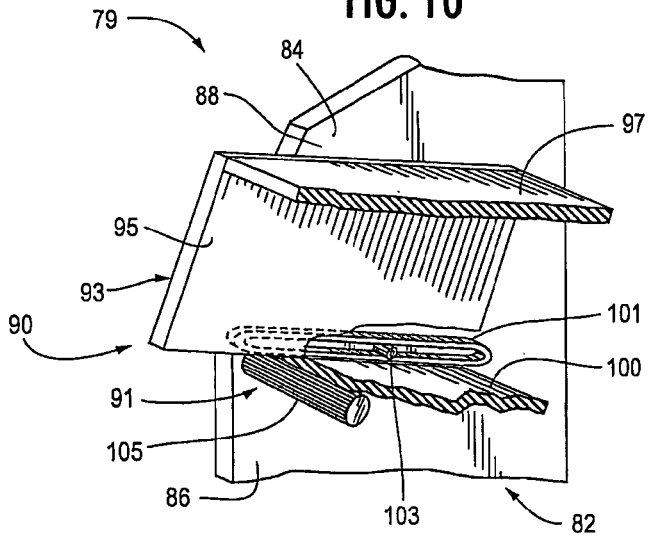
FIG. 10 is a fragmentary sectional pictorial view of a furniture construction, which is constructed in accordance with a further embodiment of the invention.

Referring now to FIGS. 8 and 9 of the drawings, there is shown a furniture construction 47, which is made in accordance with another embodiment of the invention and which is shown in the form of a computer desk for storing electronic components 49 in the form of a computer processor unit. The furniture construction 47 includes a tower housing 52 for the component 49 and a desk assembly 54 for supporting other components (not shown) such as a keyboard and monitor. It should be understood by those skilled in the art that the housing 52 could also be employed in a stand-alone configuration and not part of the desk assembly 54. The housing 52 includes a front 56 and a top 58. While the top 58 of the housing 52 is illustrated in FIG. 8 as being positioned above the top 54*a* of the desk assembly 54, the top 58 of the housing 52 may be at the same level as, or below, the top 54*a* of the desk 54. It should be understood that the front 56 could include a shelf and door of a flip down media storage unit (not shown), as described above. An opening 62 in the front 56 and top 58 open into the interior 64 of the housing 52, which defines a component compartment for storing the electronic component 49.

As shown in FIG. 9, the furniture construction 47 includes a support assembly 65 that includes a moveable support 71, such as a drawer or shelf 60 or a wire basket 36 (FIG. 25) having a handle or pull 73, and a supporting apparatus 66 having a roller 68 and a drawer stop 74 that is structured to engage the back edge of the moveable support 71 and, if desirable, the component 49 supported thereon. The roller 68 is attached to the housing 52 at the opening 62 using suitable fasteners (not shown). The roller 68 supports the moveable support 71 at a downwardly inclined angle extending between the roller 68 and the stop 74. Depending on the dimensions of the electronic component 49, the rear top edge 75 of the component may engage the inside surface of the rear 77 of the housing 52. An angular face 78 of the stop 74 provides for the proper alignment of the moveable support 71 as shown in FIG. 9.

Referring now to FIGS. 10 through 13, there is shown a furniture construction 79, which is constructed in accordance with yet another embodiment of the invention, and which includes a housing 82 similar to the housing 52 or other suitable support structures. The housing 82 includes a front 104, top 106 and lateral sides 86 defining an interior 84 therebetween that is structured to at least partially receive an electronic component (not shown) in a similar manner as the component 49 is received within the interior 64 of FIG. 8. The housing 82 includes an opening 88 similar to the opening 62 of FIG. 8. The furniture construction 79 includes a support assembly 90 comprising a moveable support 93, such as a drawer or shelf 93 or wire basket 36 (FIG. 25) configured to support an electronic component (not shown) similar to the electronic component 12 of FIG. 1 or the electronic component 49 of FIG. 8. The moveable support 93 includes a pair of lateral sides 95, a top 97 and a bottom 100 in a manner similar to the moveable support 29 of FIG. 2.

Figure 11:
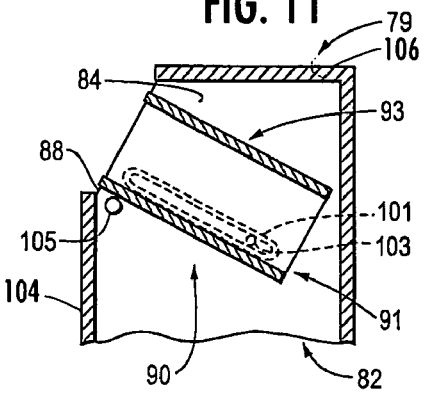
FIGS. 11 through 13 are diagrammatic fragmentary sectional side elevational views corresponding to the pictorial view of FIG. 10, illustrating progressive movement of its movable support.
Figure 12:
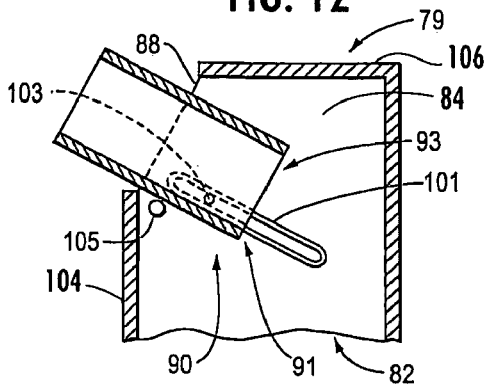

The support assembly 90 also includes a supporting apparatus 91 structured to be attached to the housing 82 and to at least partially support the moveable support 93 in the first and second positions. The supporting apparatus 91 includes a pair of tracks such as track 101 attached to the side 86 of the housing 82, it being understood that a similar track (not shown) is attached to the opposite side (not shown). A pin 103 is attached to the side 95 of the moveable support 93 to ride in the track 101 when the moveable support 93 is pulled outwardly through the opening 88 in a similar manner as the moveable support 29 is pulled outwardly into a generally horizontal disposition through the opening 21 of FIG. 1. In this regard, the tracks 101 are disposed at an angular disposition transverse to the plane of the opening 88 to support the moveable support 93 in the angular second position as shown in FIG. 11.

Figure 13:
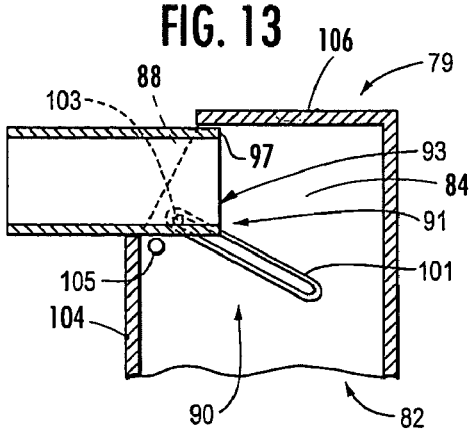

In a similar manner as the moveable support 71 of FIG. 9 moves outwardly from an inclined second position through the opening 62 into a generally horizontal first position, the moveable support 93 moves from an inclined second position (FIG. 11) to a generally horizontal position (FIG. 13) by pivoting under the force of gravity about the roller or rollers 105 of the supporting apparatus 91 once the moveable support's center of gravity is disposed outwardly from the housing 82. The moveable support 93 pivots into the generally horizontal first position as shown in FIG. 13 where the bottom of the moveable support is supported by the front 104 of the housing 82 and the top rear portion 97 of the moveable support 93 engages the underside of the housing top 106 at the opening 88.

Figure 14:
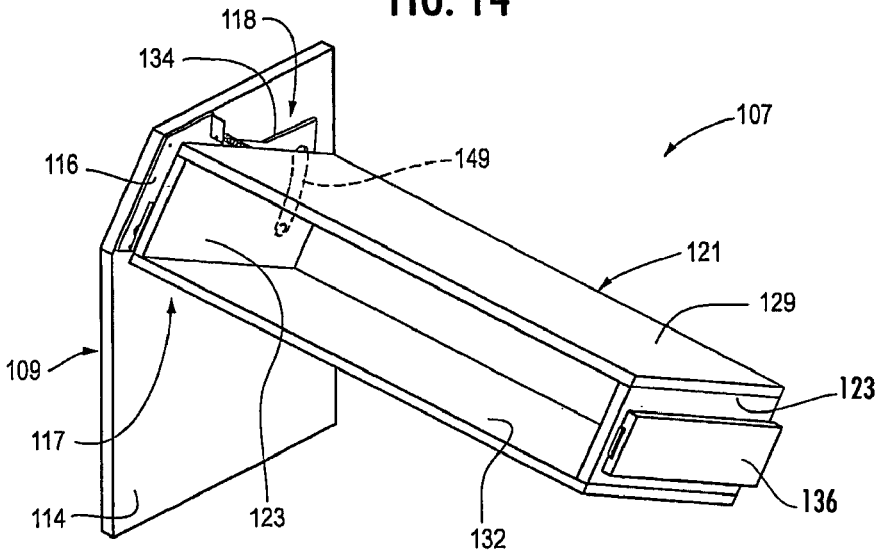
FIGS. 14, 15 and 16 are pictorial views of a furniture construction, according to another embodiment of the invention, showing the movable support advancing to a horizontal position.

Referring now to FIGS. 14 through 19, there is shown a furniture construction 107, which is made according to another embodiment of the invention and which is similar to the construction 79. The furniture construction 107 includes a housing 109 defining an interior that is structured, at least in part, for storing electronic components (not shown). The housing 109 includes a pair of sidewalls 114 and has an opening 116 providing access to the interior of the housing. The furniture construction 107 includes a support assembly 117 at least partially disposed within the interior of the housing 109. The support assembly 117 includes a moveable support 121, such as a drawer or shelf 93 or wire basket 36 (FIG. 25) configured to support an electronic component (not shown) similar to the electronic component 12 of FIG. 1 or the electronic component 49 of FIG. 8. As illustrated in FIG. 14, in one embodiment, the moveable support 121 comprises a drawer having sides 123, a top 129 with a bottom 132 in a similar manner as the drawer 23 of FIG. 2.

Figure 15:
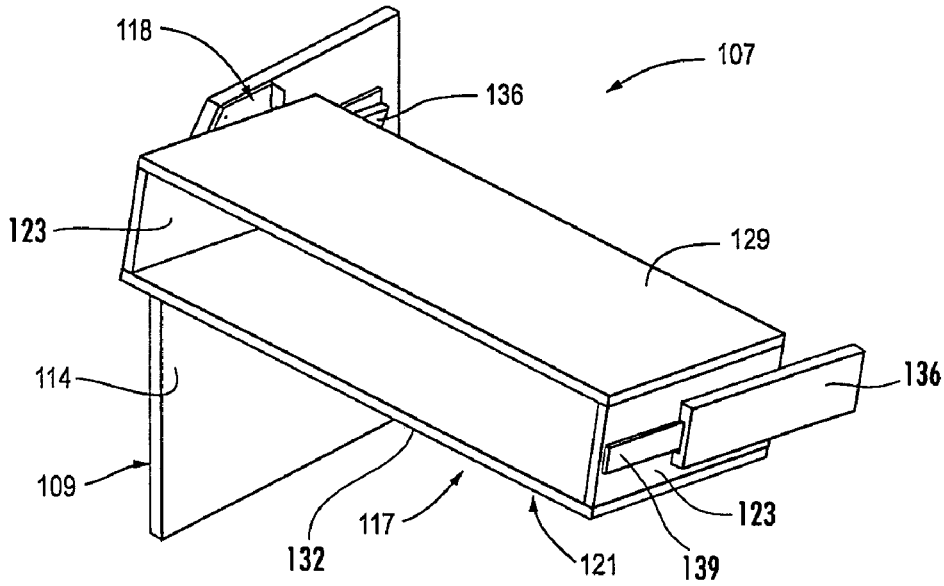
Figure 16:
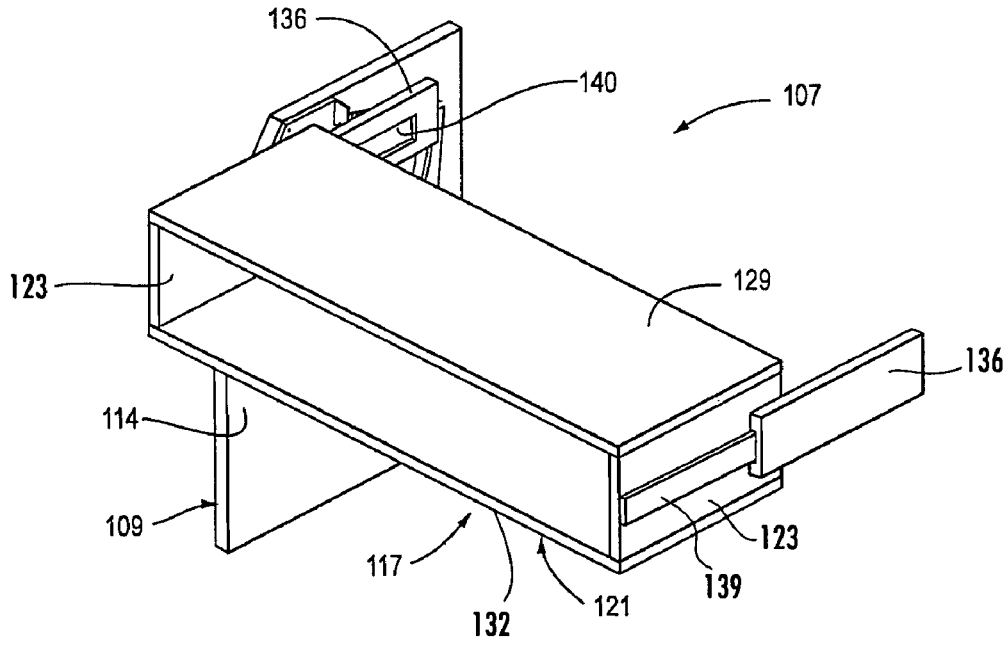
Figure 19:
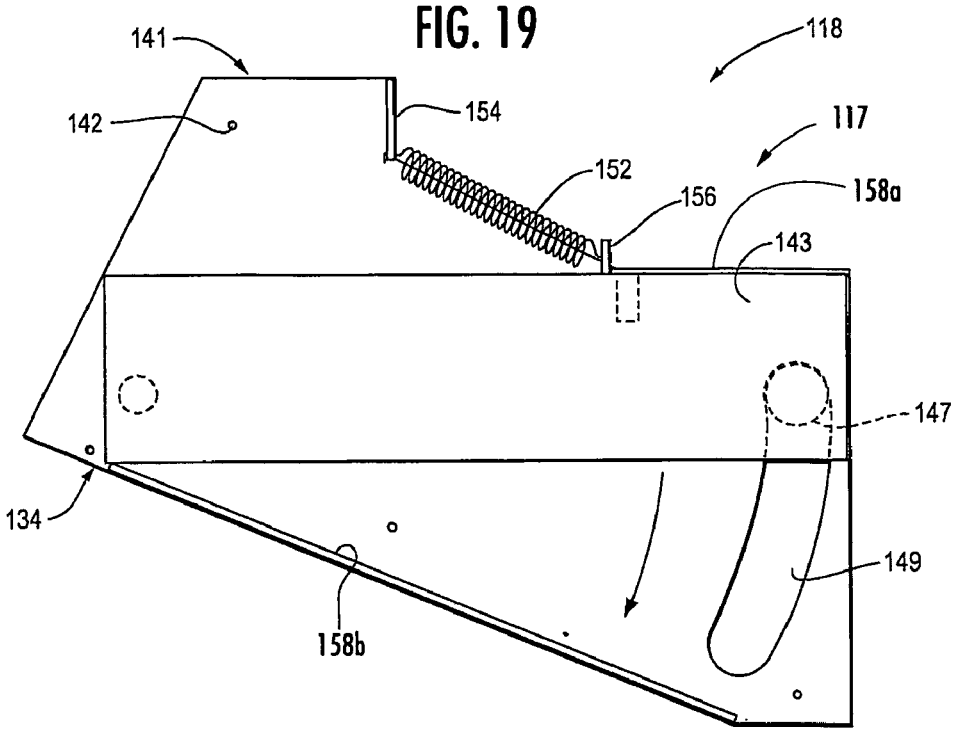
FIG. 19 is an enlarged-scale side-elevational diagrammatic view of the support apparatus illustrated in the construction of FIG. 18.

The support assembly 117 also includes a supporting apparatus 118 structured to be attached to the housing 109 and to at least partially support the moveable support 121 in the first and second positions. According to one embodiment, the supporting apparatus 118 includes a pair of brackets 134, as illustrated in FIGS. 18 and 19. Each bracket 134 can include a fixed slide plate 136, as illustrated in FIGS. 15, 16 and 17. A moveable slide plate 139 is secured to each side 123 of the moveable support 121 and is in the form of a tongue or projection that fits within a groove 140 in the plate 136. The slide plates 136 and 139 may also be in the form of ball bearing slides. As illustrated in FIG. 18, the bracket 134 also includes a base plate 141 and can include screw holes 142 to permit the fastening of the base plate 141 (and, thus, the bracket 134) to the side 114 of the housing 109. An arm 143 is pivotally mounted at a front portion 145 of the base place 141. The fixed slide plate 136 is formed integrally with the arm 143 or is secured to the arm using suitable fasteners. A pin 147 rides in an arcuate slot 149 in the base plate 141 and is attached to the free end of the arm 143. A resilient member 152, such as a spring, is stretched between an ear 154 on the base plate 141 and an ear 156 on the arm 143.

When the moveable support 121 is disposed in the angled second position, as shown in FIG. 14, the pin 147 is disposed at the bottom portion of the arcuate slot 149. In such a position, the spring 152 is stretched and, thus, is in tension. It will become apparent to those skilled in the art that while the spring 152 is shown to be a coil spring, other resilient members such as leaf springs may also be employed. The weight of the moveable support 121 and its electronic components (not shown) overcomes the tension force applied by the spring 152 so that the moveable support 121 remains in its angularly inclined position as shown in FIG. 14. When the moveable support 121 is moved toward the generally horizontal first position, as illustrated in FIG. 17, the pin 147 rides arcuately upwardly within the slot 149 and the spring tension applied by the spring 152 exerts a tangential force on the arm 143 to assist in moving (manually or otherwise) the moveable support 121 to the horizontal first position as shown in FIG. 17. In one embodiment, the base plate 141 of the bracket 134 includes a flange 158*a* that defines a stop or support for the arm 143 when in the horizontal first position. When the moveable support 121 is subsequently returned to the inclined second position within the interior of the housing 109, the pin 147 rides downwardly within the arcuate slot 149 until the arm 143 engages a second flange 158b that defines a stop or support for the arm 143 when in the inclined second position.

Figure 20:
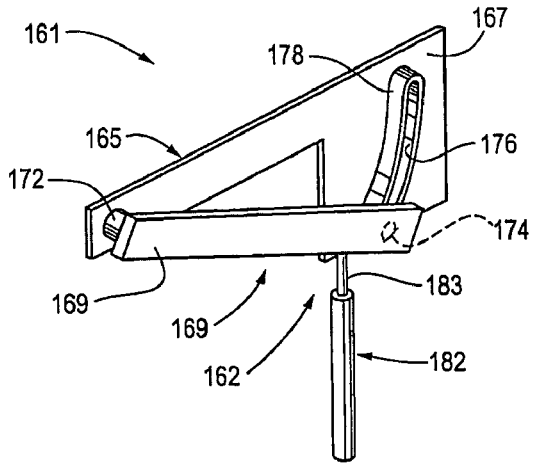
FIG. 20 is a pictorial view of a furniture construction, which is made in accordance with yet another embodiment of the invention.
Figure 21:
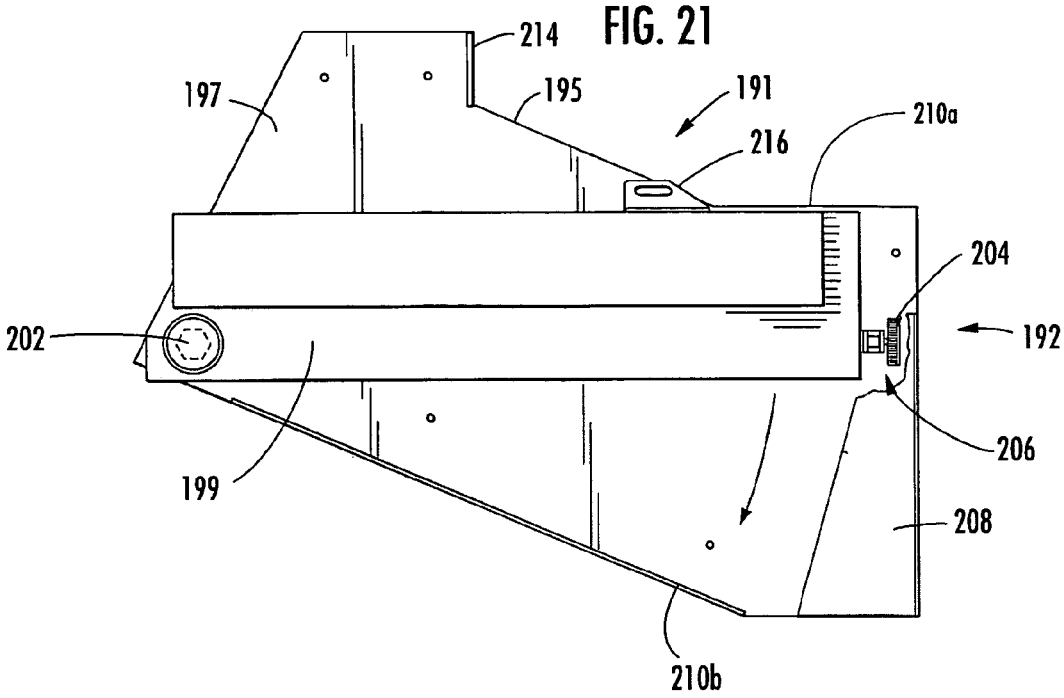
FIG. 21 is an enlarged-scale side-elevational diagrammatic view of a support apparatus, according to another embodiment of the present invention, in the first position that is generally horizontal.
Figure 22:
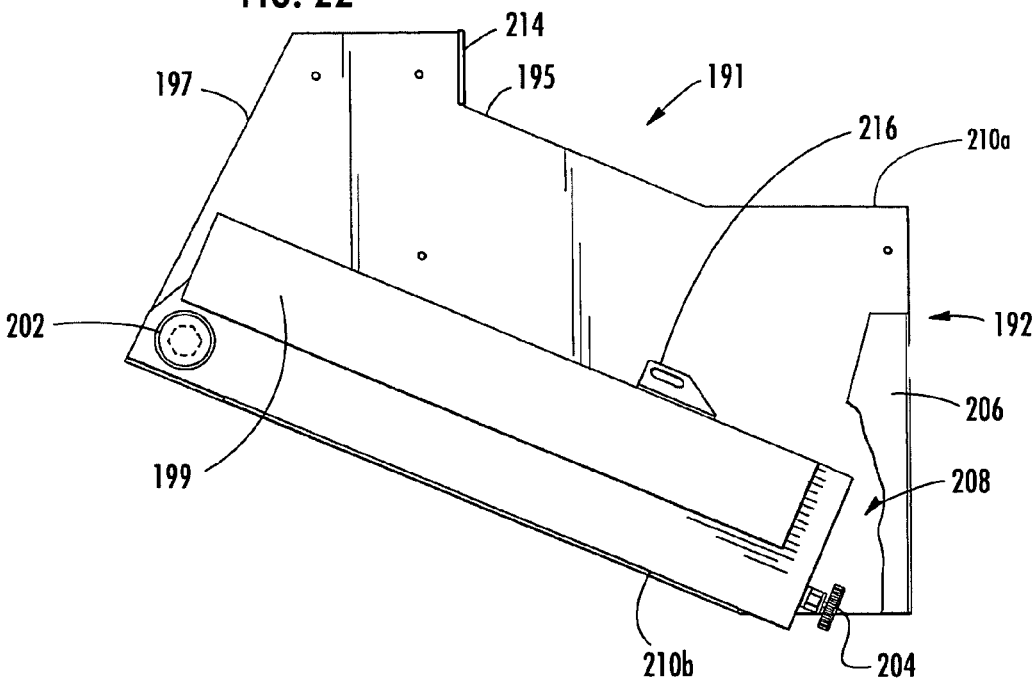
FIG. 22 is an enlarged-scale side-elevational diagrammatic view of the support apparatus in the second position that is at a downwardly inclined angle.
Figure 23:
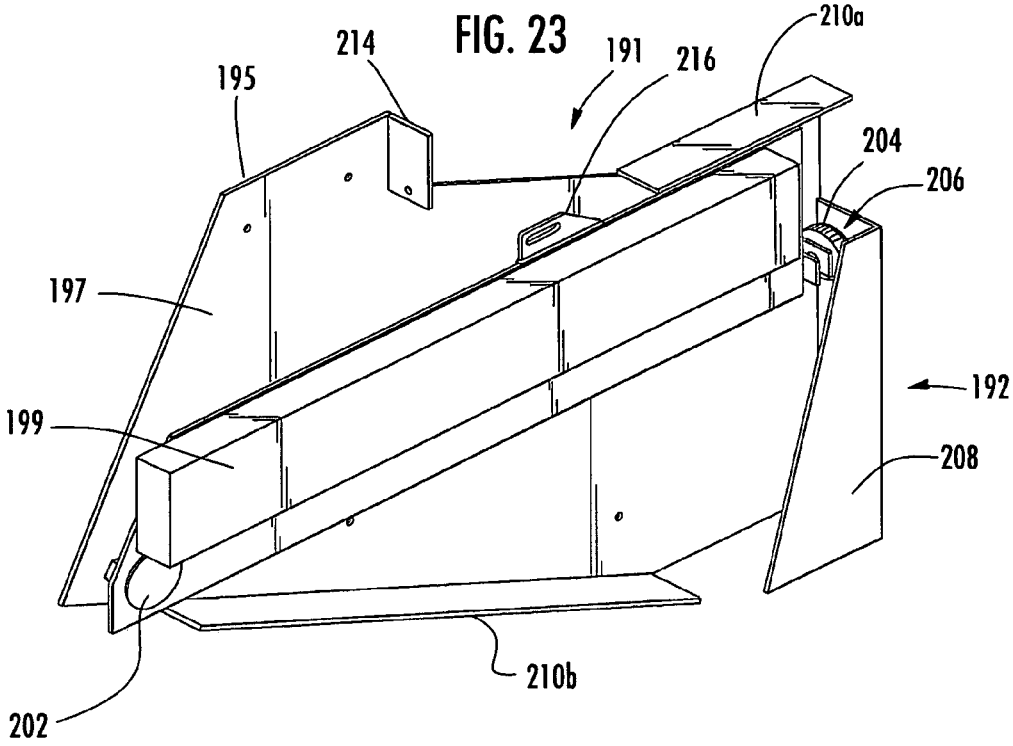
FIGS. 23 and 24 are enlarged scale pictorial views of the support apparatus of FIG. 21.
Figure 24:
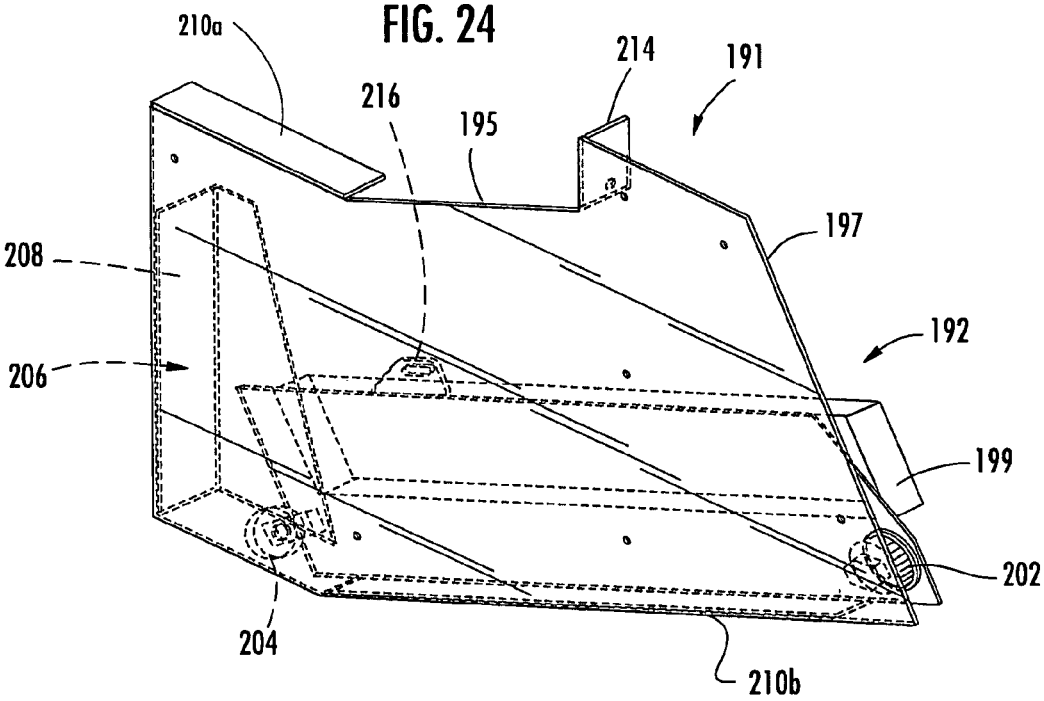

Referring now to FIG. 20, there is illustrated a support assembly 161, according to yet another embodiment of the present invention. The support assembly 161 includes a supporting apparatus 162 for supporting a moveable support (not shown), which is able to support an electronic or other component (not shown) and which may be similar to the moveable support 121 of FIG. 14 or as otherwise described herein. The supporting apparatus 162 includes a bracket 165 having a base plate 167 adapted to be attached to the side of a housing (not shown) of a furniture construction. An arm 169 is pivotally mounted on the base plate at a pivot point 172. A fixed slide plate (not shown), as described above, can be formed integrally with the arm 169 or is secured to the arm using suitable fasteners. A pin 174 is fixed to the free end of the arm 169 and rides in an arcuate slot 176 in a track 178 that is secured to or formed integrally with the base plate 167. The supporting apparatus 162 includes a motive mechanism 182 in the form of a piston-cylinder assembly 183 that is used to assist the movement of the arm 169 in a similar manner as the resilient member 152 assists the movement of the arm 143 for the bracket 134 (FIG. 19). It should be understood that the piston-cylinder assembly or other motive mechanism, such as a motor, could be used to assist and/or move the moveable support either automatically or semi-automatically. Both the bracket 134 and the bracket 165 provide a convenient mechanism for attachment to the housing for the moveable support, and may be oriented in an appropriate manner for a given furniture construction.

Referring now to FIGS. 21-24, there is illustrated a support assembly 191, according to yet another embodiment of the present invention. The support assembly 191 includes a supporting apparatus 192 for supporting a moveable support (not shown), which is able to support an electronic or other component (not shown) and which may be similar to the moveable support 121 of FIG. 14 or as otherwise described herein. The supporting apparatus 192 includes a bracket 195 having a base plate 197 adapted to be attached to the side of a housing (not shown) of a furniture construction. An arm 199 is pivotally mounted on the base plate at a pivot point 202. A fixed slide plate (not shown), as described above, can be formed integrally with the arm 199 or is secured to the arm using suitable fasteners. A roller 204 is fixed to the free end of the arm 199 and moves within a slot 206 defined by a track 208 that is secured to or formed integrally with the base plate 197. Preferably, the width of the slot 206 defined by the track 208 is only slightly larger than the roller 204 so as to restrict the side -to-side movement of the roller within the slot, while providing a sufficient spacing on either side of the roller so that the roller can move freely within the slot as the moveable support is moved between the first and second positions. A resilient member (not shown), such as a spring, is stretched between an ear 214 on the base plate 197 and an ear 216 on the arm 199. The base plate 197 can include flanges 210a and 210b that define stops or supports for the arm 199 when in the horizontal first position and the inclined second position, respectively.

The furniture constructions described herein can be formed of a variety of materials including, but not limited to, metal, solid wood, plastics and/or composites, provided the materials have appropriate structural and mechanical properties to support the electronic components. In addition, the dimensions, configuration and exterior design of the furniture constructions can vary depending upon the aesthetic and/or dimensional requirements of the furniture constructions, and can include, among others, square, rectangular, and cylindrical configurations, and combinations of these.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A furniture construction for housing at least one electronic component, comprising:

a housing having a top, and at least two side walls and defining an interior that is at least partially enclosed;

means defining an angled opening in an upper portion of the housing at the top and adapted to permit viewing the electronic component in its normal operating position; and a support assembly for supporting the at least one electronic component in an access position that is generally horizontal and disposed extending at least partially through the opening, and in the normal operating position that is at a downwardly inclined angle at least partially within the interior of said housing adapted to permit the operation of the component;

the support assembly including a movable drawer having a bottom, upstanding walls, a substantially open front and an upward rear-end portion at the upstanding walls, the rear-end portion serving as a stop engageable member;

at least one fixed inclined member extending along and parallel to the bottom of the drawer and extending at said downwardly inclined angle to support the drawer in the normal operating position;

at least one roller mounted on the housing near the angled opening to allow the drawer to move angularly relative to the inclined member through the opening until the drawer pivots under its weight into a substantially horizontal position;

a stop forming a part of the top of the housing at the interior of the housing adjacent to the angled opening; and the walls of the drawer being suitably dimensioned to allow the drawer rear-end portion to engage the stop to limit the pivoting movement of the drawer to allow the drawer to assume the horizontal access position.

2. A furniture construction according to claim 1, wherein the inclined member includes an upstanding rear wall.

3. A furniture construction for housing at least one electronic component and a plurality of media packages, comprising:

a housing having a top, and at least two side walls and defining an interior that is at least partially enclosed;

means defining an angled opening in an upper portion of the housing at the top and adapted to permit viewing of the electronic component in its normal operating position;

at least one support assembly for supporting the at least one electronic component in an access position that is generally horizontal and disposed extending at least partially through the opening, and in the normal operating position that is at a downwardly inclined angle at least partially within the interior of said housing adapted to permit the operation of the component; and at least one storage compartment adapted to receive the plurality of media packages and store the plurality of media packages within the interior of said housing, the support assembly including a movable drawer having a bottom, upstanding side walls, a substantially open front and an upward rear-end portion at the upstanding walls, the rear-end portion serving as a stop engageable member;

at least one inclined member extending along and parallel to the bottom of the drawer and extending at said downwardly inclined angle to support the drawer in the normal operating position;

at least one roller mounted on the housing near the angled opening to allow the drawer to move angularly relative to the inclined member through the opening until the drawer pivots under its weight into a substantially horizontal position;

a stop forming a part of the top of the housing at the interior of the housing adjacent to the angled opening; and the walls of the drawer being suitable dimensioned to allow the drawer rear-end portion to engage the stop to limit the pivoting movement of the drawer to allow the drawer to assume the horizontal access position.

4. A furniture construction according to claim 3, wherein the inclined member includes an upstanding rear wall.

* * * * *